US009160118B2

(12) United States Patent
Tuchrelo et al.

(10) Patent No.: US 9,160,118 B2
(45) Date of Patent: Oct. 13, 2015

(54) LIGHTED ELECTRICAL INTERCONNECT ASSEMBLY

(71) Applicant: Idea Boxx, LLC, Rochester, NY (US)

(72) Inventors: Robert Tuchrelo, Williamson, NY (US); Jeffrey Cahoon, Williamson, NY (US)

(73) Assignee: Idea Boxx, LLC, Victor, NY (US)

( * ) Notice: Subject to any disclaimer, the term of this patent is extended or adjusted under 35 U.S.C. 154(b) by 0 days.

(21) Appl. No.: 13/823,579

(22) PCT Filed: Oct. 4, 2012

(86) PCT No.: PCT/US2012/058692

§ 371 (c)(1),
(2) Date: Mar. 14, 2013

(87) PCT Pub. No.: WO2013/176697

PCT Pub. Date: Nov. 28, 2013

(65) Prior Publication Data

US 2014/0170903 A1 Jun. 19, 2014

Related U.S. Application Data

(63) Continuation-in-part of application No. 13/476,559, filed on May 21, 2012, now Pat. No. 9,028,122.

(51) Int. Cl.

| | |
|---|---|
| ***H01R 13/717*** | (2006.01) |
| *H01R 13/66* | (2006.01) |
| *H01R 13/70* | (2006.01) |

(52) U.S. Cl.

CPC ..... *H01R 13/7175* (2013.01); *H01R 13/6675* (2013.01); *H01R 13/70* (2013.01); *H01R 13/7172* (2013.01); *H01R 2201/06* (2013.01)

(58) Field of Classification Search

USPC ..... 439/488, 490, 577, 491, 620.1; 385/253, 75, 59; 362/95, 555, 657, 276

See application file for complete search history.

(56) References Cited

U.S. PATENT DOCUMENTS 5,242,315 A * 9/1993 O'Dea ..... 439/577
6,089,893 A * 7/2000 Yu et al. ..... 439/225

(Continued)

FOREIGN PATENT DOCUMENTS

JP 10-247560 A 9/1998
JP 2001-519077 A 10/2001

OTHER PUBLICATIONS

PCT International Search Report and Written Opinion of the International Searching Authority dated Mar. 11, 2013 in corresponding PCT Application No. PCT/US12/58692 (9 pages).

*Primary Examiner* — Alexander Gilman
(74) *Attorney, Agent, or Firm* — Timothy W. Menasco, Esq.; Harter Secrest & Emery LLP

(57) ABSTRACT

An electrical interconnect assembly, comprising an electrical conductor a housing having a terminal end, a connector connected to the conductor and the housing and extending along a longitudinal axis from the terminal end of the housing, the connector having a terminal surface spaced from the housing, a light emitter within the housing, and a light guide within the housing to direct light from the light emitter to exit the housing from the terminal end to substantially illuminate the connector. Also, an electrical interconnect assembly comprising, a housing having a terminal end, a receptacle in the housing, the receptacle having an opening at the terminal end of the housing and a back wall, and a longitudinal axis extending orthogonally from the back wall; and a light emitter within the receptacle, the receptacle directing light from the light emitter to exit the housing from the terminal end to substantially illuminate the receptacle.

9 Claims, 9 Drawing Sheets

(56) References Cited

U.S. PATENT DOCUMENTS

| | | | | |
|---|---|---|---|---|
| 6,095,970 | A * | 8/2000 | Hidaka et al. | 600/110 |
| 6,319,051 | B1 * | 11/2001 | Chang et al. | 439/490 |
| 6,336,825 | B1 * | 1/2002 | Seefried | 439/488 |
| 6,457,992 | B2 * | 10/2002 | Posey et al. | 439/490 |
| 6,474,999 | B1 * | 11/2002 | Givens et al. | 439/76.1 |
| 6,690,804 | B2 * | 2/2004 | Everett | 381/91 |
| 6,699,065 | B1 * | 3/2004 | Espenshade et al. | 439/490 |
| 6,733,333 | B1 | 5/2004 | Chen | |
| 6,752,649 | B2 * | 6/2004 | Arkin et al. | 439/491 |
| 6,921,284 | B2 * | 7/2005 | Sirichai et al. | 439/490 |
| 7,004,595 | B1 * | 2/2006 | Stoddard | 362/95 |
| 7,036,948 | B1 * | 5/2006 | Wyatt | 362/95 |
| 7,175,327 | B1 * | 2/2007 | Tsai | 362/555 |
| 7,628,619 | B2 * | 12/2009 | Chuang | 439/76.1 |
| 7,744,231 | B2 * | 6/2010 | Hutchinson et al. | 362/95 |
| 7,976,336 | B2 * | 7/2011 | Yang et al. | 439/490 |
| 8,128,558 | B2 * | 3/2012 | Amling et al. | 600/132 |
| 8,303,333 | B2 * | 11/2012 | Lee | 439/488 |
| 8,475,203 | B2 * | 7/2013 | Wu | 439/490 |
| 8,823,540 | B2 * | 9/2014 | Scholeno | 340/815.42 |
| 2008/0249363 | A1 * | 10/2008 | Nakamura et al. | 600/132 |
| 2009/0042433 | A1 * | 2/2009 | Bushby | 439/352 |
| 2010/0309657 | A1 * | 12/2010 | Purdy et al. | 362/200 |
| 2011/0256769 | A1 * | 10/2011 | Wu | 439/620.02 |
| 2012/0202385 | A1 * | 8/2012 | Miyagi et al. | 439/626 |
| 2012/0289080 | A1 * | 11/2012 | Huang et al. | 439/502 |
| 2013/0171875 | A1 * | 7/2013 | Kwon | 439/620.01 |

* cited by examiner

LIGHTED ELECTRICAL INTERCONNECT ASSEMBLY

CROSS-REFERENCE TO RELATED APPLICATIONS

This application is a National Stage (371) of International Application No. PCT/US2012/058692 filed Oct. 4, 2012, which is a continuation-in-part of U.S. application Ser. No. 13/476,559, filed May 21, 2012.

STATEMENT REGARDING FEDERALLY SPONSORED RESEARCH OR DEVELOPMENT

None.

REFERENCE TO A "SEQUENCE LISTING"

None.

BACKGROUND OF THE INVENTION

1. Technical Field

The present system relates to electrical interconnect assemblies and more specifically to lighted interconnect assemblies having a connector or receptacle and a light emitter that illuminates the connector or receptacle to aid in locating the lighted connector into a receptacle or the lighted receptacle into a connector.

2. Description of the Related Art

Electrical interconnect assemblies are used for a multitude of purposes. Universal Serial Bus (USB) electrical connector assemblies, for example, permit communication between a computer and electrical devices. USB is an external computer interface industrial standard that defines the communication protocols, cables and connectors that enable such communication between devices. Typically, a USB receptacle, which is a male receiving portion, mounts to a computer or other device for receiving a USB connector or plug of an electrical connector assembly. USB devices, for example, may be connected to a USB receptacle of a computer using a USB cable having two terminal ends with USB plugs inserted into the USB receptacles of the computer and electrical device.

Most computers today include multiple USB receptacles for connecting USB devices such as PDAs, cellular phones and video game consoles, and for connecting computer peripherals to permit communication between the computer and printers, scanners, keyboards, pointing devices, and external hard drives. USB receptacles also permit communication between computers and mass storage devices, often referred to as a flash drive or a thumb drive, for storing large quantities of data. Even certain LED, Plasma and LCD televisions now include multiple USB receptacles.

USB cabling has eliminated the need for a separate power charger for a portable device since power is provided from the computer to the device by the USB cable. Some cable connectors include lights, which indicate when power is received from the computer. Thus, one knows when the USB cable is successfully connected to the computer. However, since power is not provided until after the USB cable is plugged into the receptacle, this light cannot be used to illuminate the USB connector or receptacle when inserting the connector into the receptacle. Since USB receptacles are small and often in discrete locations that are not well-lit, many find it difficult to align and insert connectors into receptacles. Further, because it is difficult to see the receptacle receiving the connector, it is easy to insert the connector into a wrong-sized receptacle or misalign the connector and receptacle, thereby bending the connector or damaging the pins or other electrical contacts inside the connector and receptacle.

What is needed, then, is an electrical interconnect assembly that emits light to substantially illuminate the connector and/or corresponding receptacles to facilitate the interconnection of the connector and receptacle. Also needed is a lighted electrical interconnect assembly that is configured to attach to a preexisting USB connector. The need also exists for a battery powered electrical interconnect assembly capable of emitting light from a terminal end of the housing to substantially illuminate the connector and/or corresponding receptacle whether or not power from the computer is available.

BRIEF SUMMARY OF THE INVENTION

The electrical interconnect assembly of the present system provides for illumination of a plug and/or receptacle during insertion.

In one configuration, the electrical interconnect assembly includes an electrical conductor, a housing, a connector, a light emitter, and a light guide. The housing encloses a portion of the conductor and includes a terminal end. The connector is connected to the conductor and the housing and extends along a longitudinal axis from the terminal end of the housing. The connector further includes a terminal surface spaced from the housing. The light emitter and a portion of the light guide are disposed within the housing. The light guide directs light from the light emitter to exit the housing from the terminal end to substantially illuminate the connector along the longitudinal axis.

In one configuration, the light guide directs a portion of the light to intersect a portion of the connector. The electrical interconnect assembly in another configuration includes the light guide directing a portion of the light to pass from the terminal end within a periphery of the connector.

In another configuration, an electrical interconnect assembly comprises a housing having a terminal end, a receptacle in the housing, the receptacle having an opening at the terminal end of the housing and a back wall, the receptacle having a longitudinal axis extending orthogonally from the back wall, and, a light emitter within the receptacle, the receptacle directing light from the light emitter to exit the housing from the terminal end to substantially illuminate the receptacle along the longitudinal axis.

In yet another configuration, an electrical interconnect assembly for use with a male connector comprises a housing having a terminal end, the terminal end having an aperture, an electrical conductor within the housing, a female receptacle portion at the terminal end of the housing, the female receptacle portion having an opening aligned with the aperture and defined by four sidewalls and a back wall opposite the opening, each of the sidewalls including an inside surface facing the male connector when the male connector is in an inserted position, a longitudinal axis orthogonal to the back wall, and, a light emitter proximate the electrical conductor, the female receptacle portion directing light from the light emitter to exit the housing from the terminal end to substantially illuminate the opening of the female receptacle portion along the longitudinal axis. In one configuration, the electrical interconnect assembly supplies power to the light emitter. For example, the electrical conductor can include a battery in the housing for supplying power to the light emitter. In another configuration, the electrical connect assembly is integral a computer or other device and the light emitter is powered by such device.

DETAILED DESCRIPTION OF THE INVENTION

Figure 1:
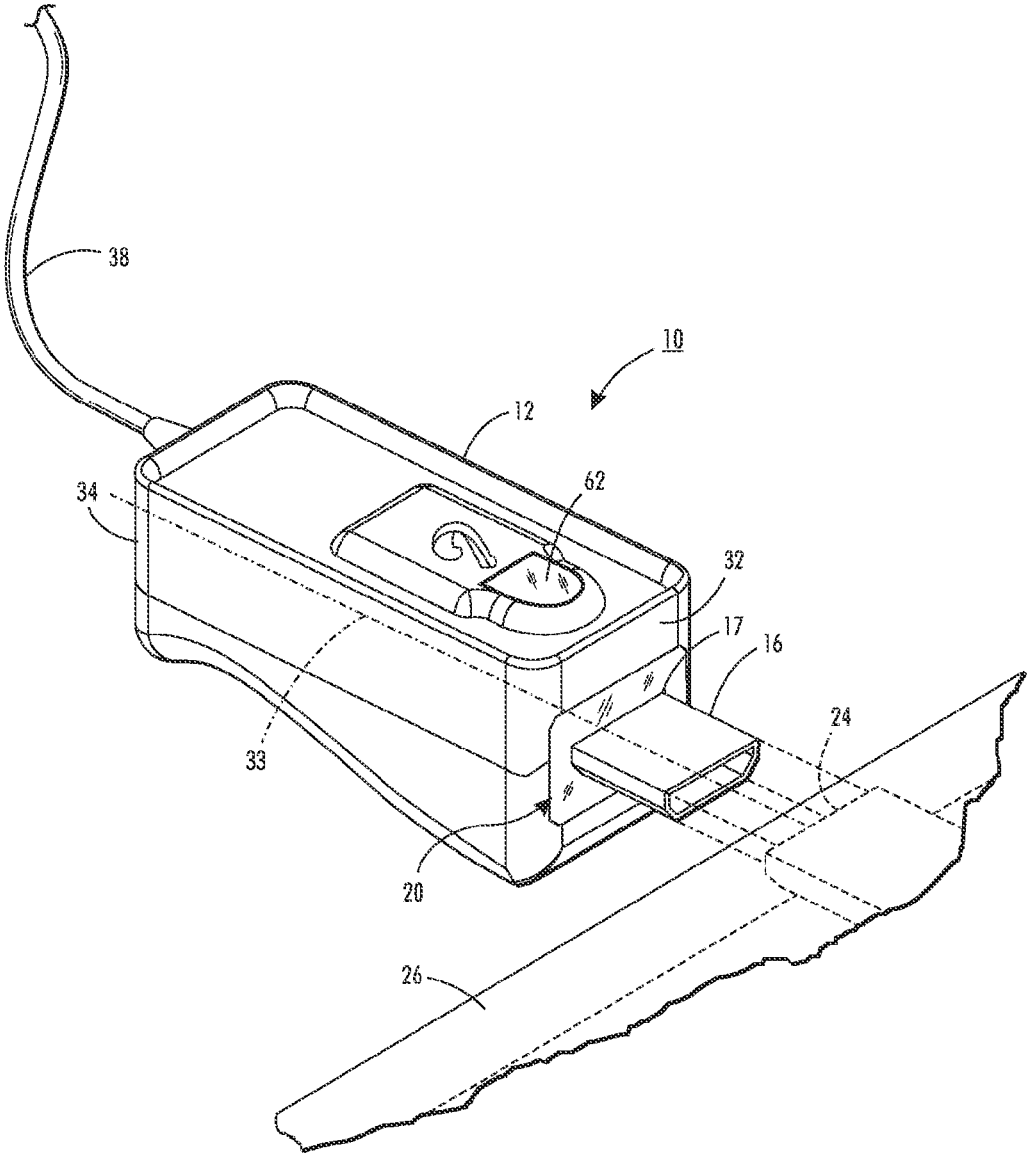
FIG. 1 is a perspective view of a configuration of an electrical interconnect assembly.

At the outset, it should be appreciated that the use of the same reference number throughout the several figures designates a like or similar element.

Referring now to the Figures, an electrical interconnect assembly 10 includes a housing 12, an electrical conductor 14, a connector 16, a light emitter 18, and a light guide 20 or 82. The light guide 20 or 82 directs light from the light emitter 18 towards a terminal surface 22 of the connector 16 to illuminate a receptacle 24 mounted on a device 26 receiving the connector 16, for example a computer.

Figure 3:
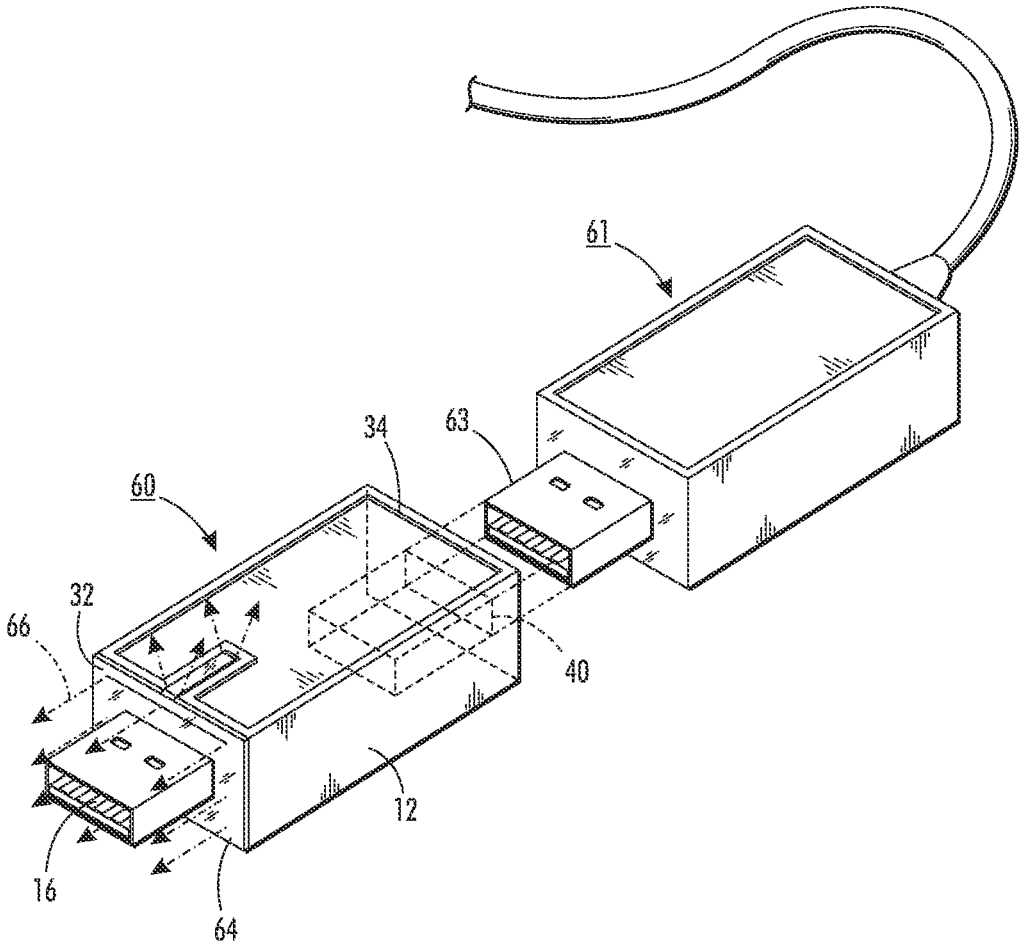
FIG. 3 is a perspective view of the electrical interconnect assembly illustrating the electrical interconnect assembly aligned for attaching to a USB cable.
Figure 4:
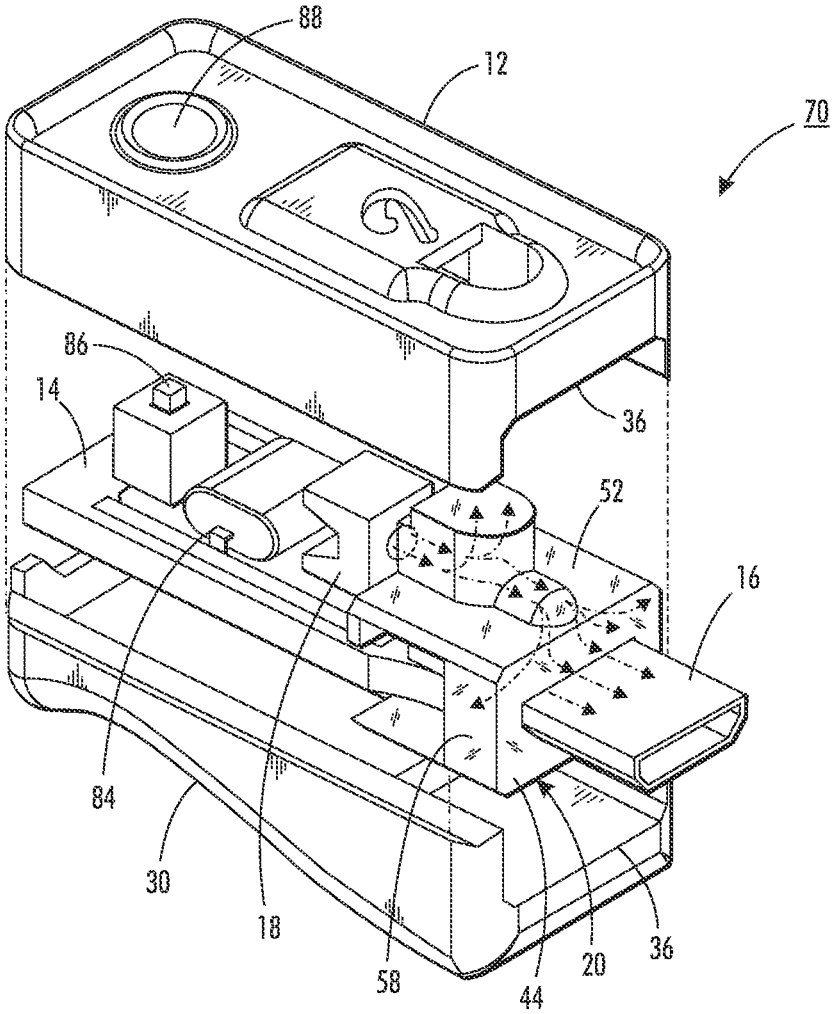
FIG. 4 is an exploded schematic view of another configuration of the electrical interconnect assembly illustrating a battery operated electrical interconnect assembly.
Figure 5:
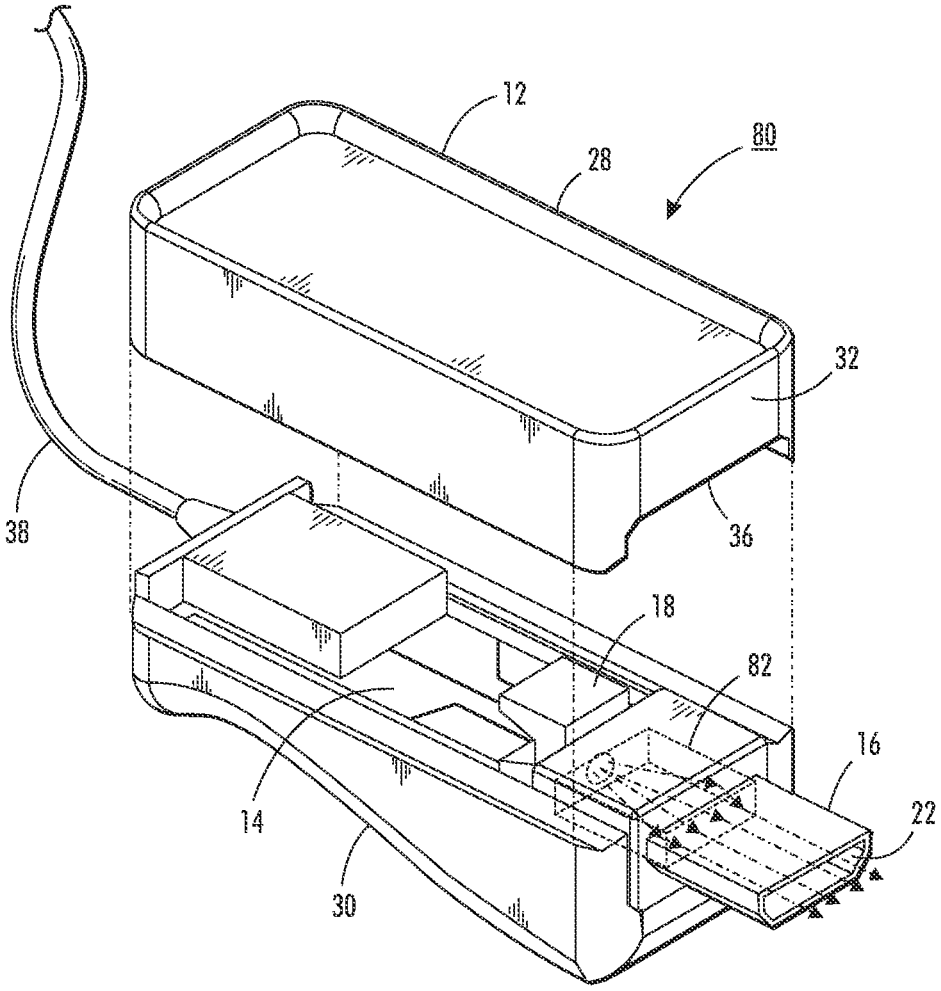
FIG. 5 is an exploded schematic view of yet another configuration of the electrical interconnect assembly illustrating a light guide directing light within a periphery of a connector.

Without limiting the scope of the disclosure, the electrical interconnect assembly 10 is set forth in terms of a USB electrical interconnect assembly having a standard USB connector 16 connected to the electrical conductor 14, and includes, but is not limited to USB cables, charging cables, mass storage devices and lighted attachments. For example, as shown in FIGS. 1 and 5, the electrical connector assemblies 10 and 80, respectively, are each a USB cable having at least one end with a USB plug. Either one end or multiple ends of the cable may include the light emitter 18 and light guide 20, 82 for illuminating receptacle region(s) of a computer 26 and/or other host device. In another configuration, as shown in FIG. 4, the electrical interconnect assembly 10 is a mass storage device, such as a flash drive. Alternatively, the electrical connector assemblies 50, 60 are stand alone attachments for a USB cable 61 having a USB plug 63. The electrical connector assemblies 50, 60 each serve as an intermediate component between the USB plug 63 and the computer 26 or other host device. The electrical connector assemblies 50, 60 illuminate the connector 16 and the receptacle 24, as shown in the configurations illustrated in FIGS. 2 and 3, respectively. The USB cable 61 may include a "twisted pair" of wires having "Data +" and "Data −" conductors twisted together in a double helix, as well known in the art.

Figure 2:
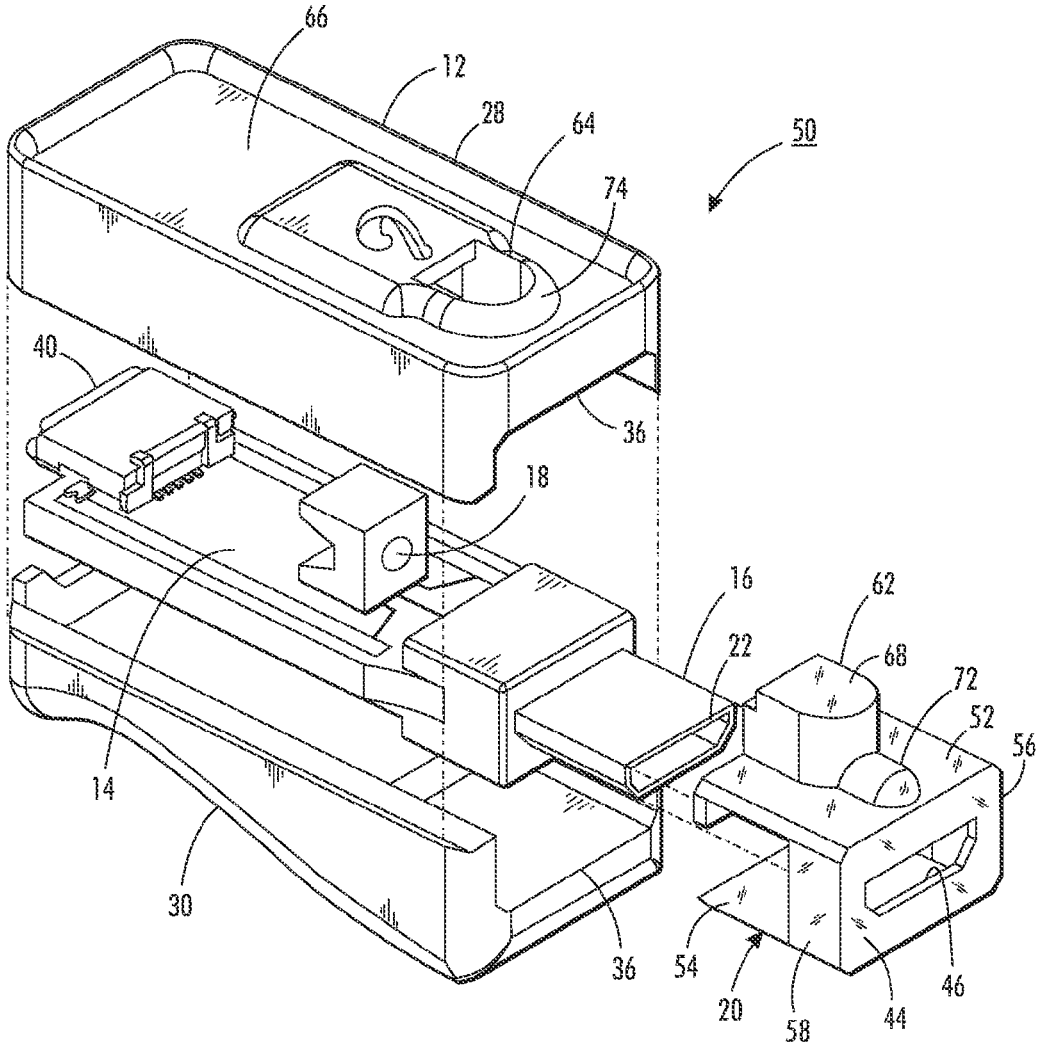
FIG. 2 is an exploded schematic view of the electrical interconnect assembly shown in FIG. 1, except illustrating a connector box rather than a cable.

As shown in the Figures, the housing 12 is dimensioned for enclosing the electrical conductor 14 and the light emitter 18. The housing 12 may include an upper housing 28 and the lower housing 30 as shown in FIGS. 1, 2, 4 and 5. Alternatively, the upper housing 28 and lower housing 30 may be integral as shown in FIG. 3. In both configurations, the housing 12 includes a terminal end 32, a longitudinal axis 33 and a front end 34. The connector 16 includes sidewalls 13*a,b* and 15*a,b* and extends along the longitudinal axis 33 of the terminal end 32, wherein an end 17 of the connector 16 aligns with and is adjacent to the terminal end 32 of the housing 12. In certain embodiments, the upper housing 28 and lower housing 30 include notches 36 through which the connector 16 extends. Without limiting the scope of the disclosure, the front end 34, may include a cable 38 as shown in FIG. 1 or a connector box 40, as shown in FIGS. 2 and 3 for connecting the electrical interconnect assembly 50 or 60 to another cable. The connector box 40, in one configuration, is a USB receptacle configured for receiving a USB connector.

The housing 12 is preferably substantially opaque such that light does not pass through the housing. The light guide directs light towards the terminal end 32 of the housing and additionally or alternatively, within a periphery of the connector 16 from the terminal end 32 of the electrical interconnect assembly 80 through the terminal surface 22 of the connector 16 as described in more detail below.

As illustrated in the Figures, the connector 16 is coupled to the electrical conductor 14 at the terminal end 32 of the housing 12 and generally extends along the longitudinal axis 33. The connector 16 has a terminal surface 22 spaced from the housing 12. In one construction, the electrical conductor 14 is a USB printed circuit board (PCB), which is known in the art. The electrical conductor 14 may include an integral USB plug as the connector 16. However, any similar media having the necessary electrical componentry to enable illumination of a light emitter 18 can be used as the electrical conductor 14 (i.e., a small drop resister). Thus, in this configuration, as shown in FIG. 4, the electronic conductor assembly 70 is a mass storage device such as a flash drive having a USB plug as a connector 14. Alternatively, the electronic conductor assembly 10 or 80 may be a plug at one end of a USB cable as shown in FIGS. 1 and 5. The USB cable may include multiple connectors 14, such as a USB plug or any other type of plug or receptacle configuration required by different OEM requirements, on at least two terminal ends of the USB cable. Currently there are several USB connector configurations on the market, including, Standard A, Standard B, Mini-A, Mini-B, Micro-A and Micro-B. Thus, the USB cable may include on one end of the cable, a USB Standard A plug, while the other end of the cable may be a Micro-B, Mini-B, or Standard B plug. Although the other end of the cable may instead be a Micro-A plug or a Standard A plug, these configurations do not meet the USB standard.

Figure 6:
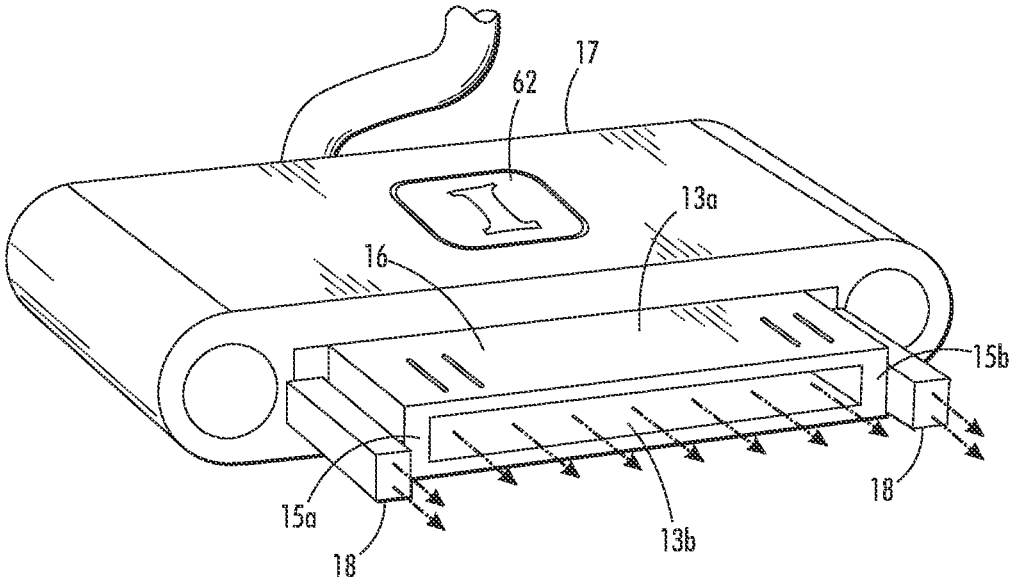
FIG. 6 is a perspective view of another configuration of an electrical interconnect assembly having light guides adjacent two sidewalls of the connector.
Figure 7:
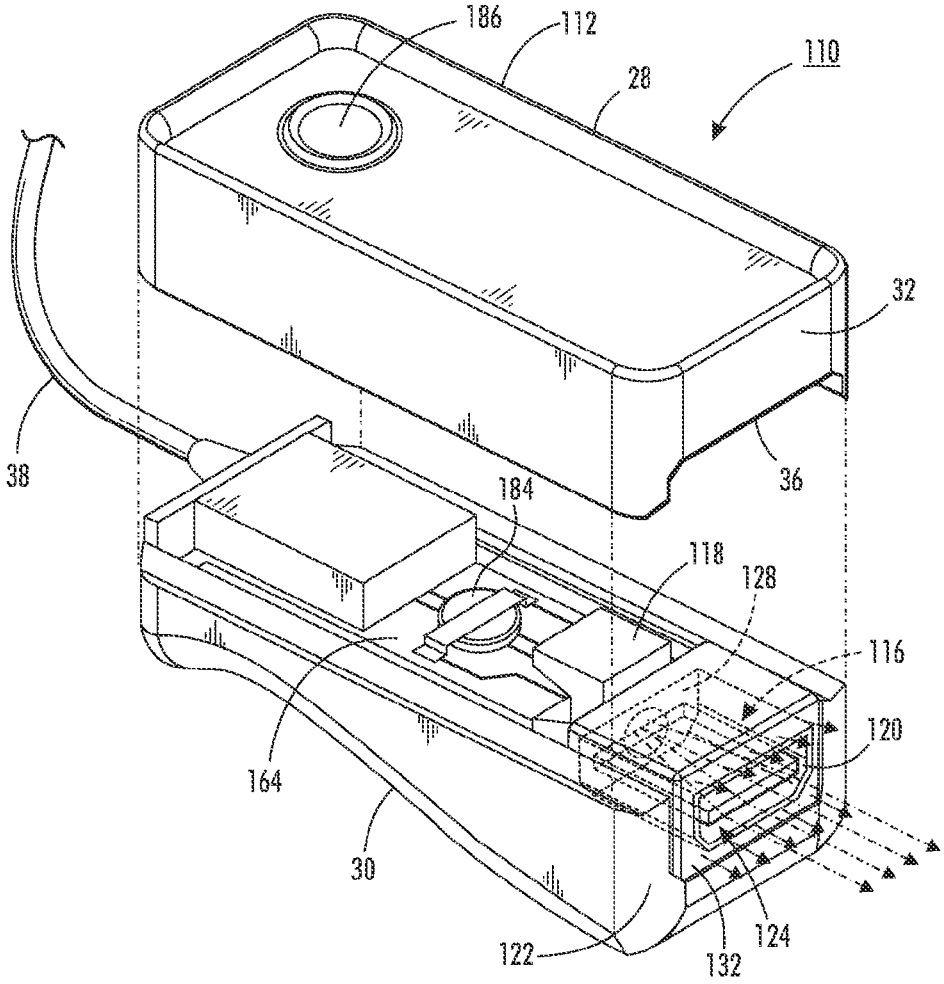
FIG. 7 is a perspective view of another configuration of an electrical interconnect assembly having a female socket portion illustrating a light guide directing light around and within a periphery of a female socket portion.
Figure 8:
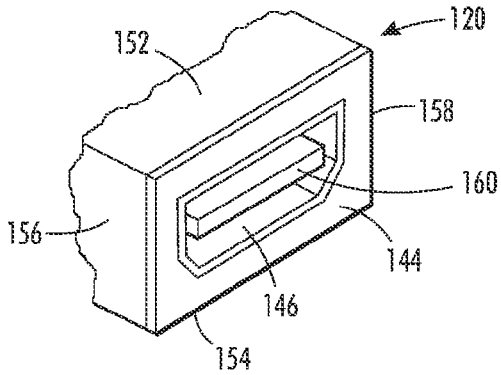
FIG. 8 is a perspective view of a light guide of the electrical interconnect assembly.
Figure 9:
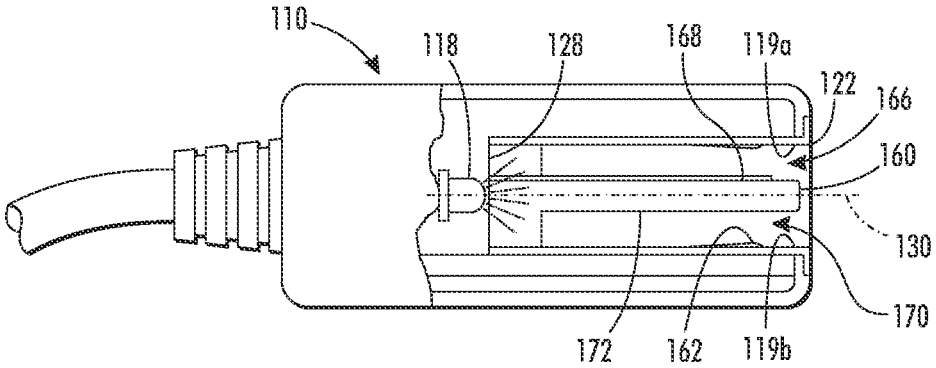
FIG. 9 is a side elevational view of the electrical interconnect assembly having a female socket portion with a portion of the housing removed.
Figure 10:
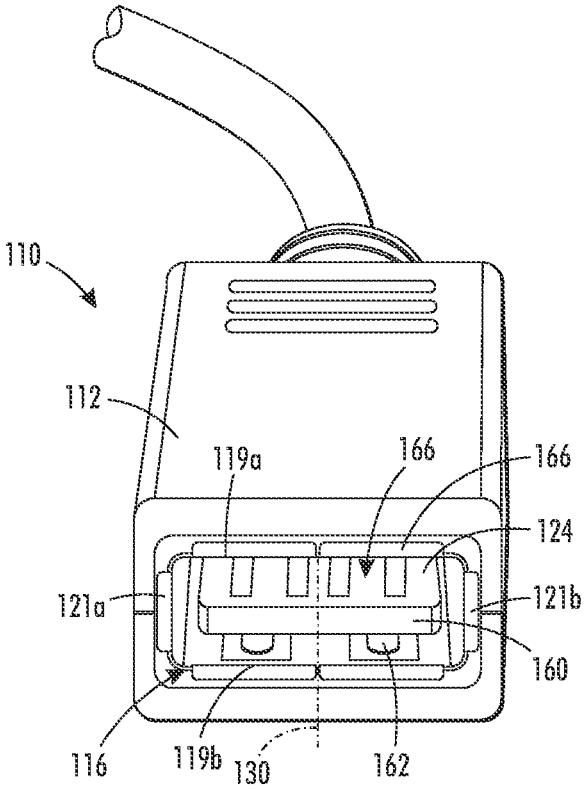
FIG. 10 is a perspective view of the electrical interconnect assembly having a female socket portion.

For purposes of this disclosure, the light emitter 18 is a light emitting diode (LED) light bulb secured or bonded to the electrical conductor 14, as shown in FIGS. 1-5. In another configuration, the light emitter 18 is suspended or encapsulated in a material, such as a translucent or transparent plastic forming at least a portion of the housing 12. In a further configuration, two light emitters 18 are adjacent sidewalls 15*a,b* at the end 17 of the connector 16, as shown in FIG. 6, and aid in the insertion of the electrical connector 10 by illuminating the receptacle region of a computer 26 and/or other host device. While the light emitter 18 can be other types of lights known in the art, an LED light has been found to be satisfactory as LED lights do not generate a significant amount of heat and use less energy than other types of bulbs, such as incandescent and fluorescents.

The bonding of the LED light to the electrical conductor 14 can be formed by a variety of conductive connecting materials known in the art, including but not limited to solder and adhesives.

The light guide 20 or 82 is positioned substantially within the housing to direct light from the light emitter 18 to exit the housing 12 from the terminal end 32. The light guide 20 can include a translucent and/or transparent (i.e., clear) housing. Acrylic plastic has been found to be satisfactory materials for the light guide 20 or 82. In another configuration, the light guide 82 is coupled to or is part of a housing of the light emitter 18.

As shown in FIGS. 2 and 4, the light guide 20 includes a substantially annular front surface 44 having an opening 46 for receiving the connector 16, a top wall 52 and bottom wall 54, and two sidewalls 56, 58. The front surface 44 of the light guide 20 substantially aligns with the terminal end 32 of the housing 12. In the assembled configuration, the front surface 44 of the light guide 20 abuts the circumference of the connector 16 to provide 360 degrees of illumination around the connector 16. The light guide 20, in certain configurations also includes an indicator 62 which extends through an opening 64 in the top portion 66 of the housing 12 such that a top portion 68 of the indicator 62 is exposed and substantially flush with the top portion 66 of the housing 12. The indicator 62 may further include an alignment tab 72 for engaging a rim 74 on the top portion 66 of the housing 12. The indicator 62 passes light when the light emitter 18 receives power (and generates light). Thus, illumination of the indictor 62 indicates the light emitter 18 is receiving power. In one configuration, the light guide 20 can include at least one reflector (not shown) for directing (reflecting) the light from the light emitter 18 to the front surface 44 of the light guide 20. Thus, the light is projected from the terminal end 32 of the housing 12 around the entire circumference of the connector 14 and in some embodiments, through an indicator 62, without also projecting through other portions of the housing 12. This provides, among other things, light sufficient for illuminating the connector 16 and a receiving area on a device, such as a USB receptacle of a device.

The light from the light emitter 18 may further be directed through both the light guide 20 and the connector 16 as shown in FIG. 4. Thus, light can be projected substantially along the longitudinal axis about the periphery of the connector, or within the periphery of the connector or both about and within the periphery of the connector.

That is, in a further construction, as shown in FIG. 5, the light from the light emitter 18 may instead be directed solely within a periphery of the connector 16 from the terminal end 32 of the electrical interconnect assembly 80 towards the terminal surface 22 of the connector 16 by light guide 82. While this construction can be used with any connector type, it has been found to be satisfactory for USB Standard A plug types.

In yet another configuration, as shown in FIGS. 7-10, a female electrical interconnect assembly 110 for receiving a male connector includes a housing 112, an electrical conductor 164, a receptacle, such as a socket 116, a light emitter 118.

The lighted electrical interconnect assemblies 10, 50, 60, 70, 80, 110 can be designed to be powered by a battery or the USB interface, that is, a USB connection between one of multitude electrical connector assemblies connected to a powered host device. In the battery powered configuration, such as that shown in FIGS. 4 and 7 the electrical interconnect assembly 70, 110 includes a rechargeable battery 84 or 184. The rechargeable battery 84 or 184 may be configured to be recharged with the USB interface. In this configuration, power is drawn from a host computer or device and stored in the battery 84 or 184. The battery 84 or 184 then provides power to the light emitter 18 or 118 when a switch button 86 or 186 is activated. In certain embodiments, the switch button 86 or 186 allows selective switching between various illumination modes such as increasing light levels of the light emitter. The electrical interconnect assembly 70, 110 in this configuration may include a control circuit (not shown) to control the illumination mode of the light emitter when the switch button 86 is activated and a mode is selected.

As shown in FIG. 4, the switch button 86 may be located in an opening 88 of the housing 12. That is, in one configuration, both the light guide 20 or 82 and the indicator 62 are illuminated when the switch button 86 is activated.

In another configuration, the indictor 62 is illuminated by the same LED as the light guide 20, indicating power is being received from a sole power source, either a battery 84 or USB. Alternatively the indicator 62 may be illuminated by a different LED and power source. In this configuration, one light emitter illuminates the light guide 20 that is powered by the rechargeable battery 84 to provide illumination for accurate placement of the connector 16 into the receptacle while a different light emitter (not shown) illuminates the indicator 62 indicating power is received from a USB power source when the connector 16 is successfully inserted into the receptacle 24. The indictor 62 may be used to orient the connector 16. For example, the indicator 62 may be positioned on the top portion 66 of the housing 12 to indicate the proper position and alignment of connector 16 during insertion.

As shown in FIGS. 7-11, in some configurations the electrical interconnect assembly 110 includes a light guide 120. The light guide 120 directs light from the light emitter 118 towards a terminal end 122 of the housing 112 to illuminate the socket 116 for receiving a male connector.

The electrical interconnect assembly 110 may be a female adaptor, a female port, including but not limited to a microphone input port and a headphone output port, or a female connector, including but not limited to a USB connector, DB-Type Connectors, centronics connectors, SCSI Connectors, DIN-Type Connectors, and data connectors. The female adaptor, port and/or connector may be within a host device or may be part of a female connector assembly coupled to a cable for receiving a male connector.

The housing 112 may be a computer or electronic device portion having an aperture 126 with the socket 116 therein or an adaptor or connector for coupling to a computer or electronic device. Preferably, the housing 112 is substantially opaque to inhibit light from the light emitter 118 from passing through. The terminal end 122 of the housing 112, however, may include the light guide 120 to direct light towards the terminal surface 122 of the housing 112.

Figure 11:
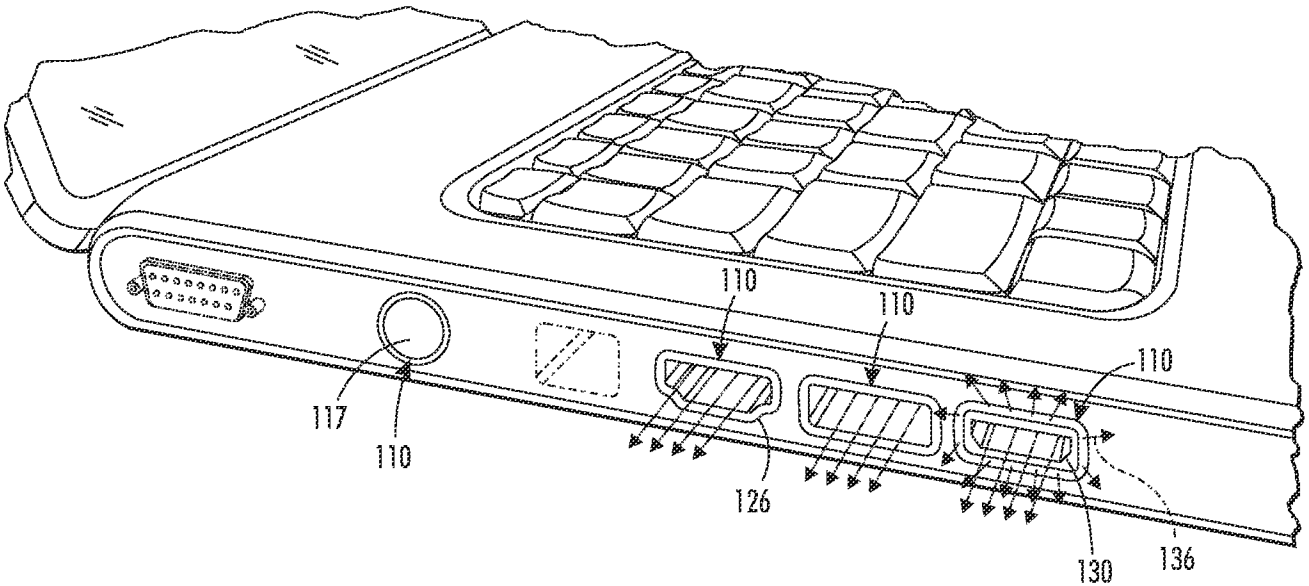
FIG. 11 is a perspective view of a device having a plurality of electrical receptacle assemblies.

The socket 116 is located at a terminal end 122 of the housing 112 and includes an opening 124 aligned with an aperture 126 in the housing 112. In a rectangular configuration, for example a socket configured to receive a USB connector, the socket 116 is defined by two pairs of opposing sidewalls 119 *a, b* and 121 *a, b*, which include an inside surface which face the male connector when the male connector is in an inserted position. In a cylindrical configuration, for example a socket 117 configured to receive an RCA plug or mini-plug as shown in FIG. 11, the socket 117 is defined by a substantially circular sidewalls 115 having an inside surface facing the male connector when the male connector is in an inserted position. The female electrical interconnect assembly 110 may include a back wall 128 opposite the opening 124. The back wall 128 may be integral to the socket 116, formed from housing 112 or formed as a separate portion proximate the socket 116. A longitudinal axis 130 extends from the back wall 128 towards the opening 124 and is generally orthogonal to the back wall. In one configuration, the light emitter 118 is proximate the back wall 128 such that light enters the socket 116 proximate the back wall 128 and exits the housing 112 from the terminal end 122 to substantially illuminate the opening 124 of the socket 116 along the longitudinal axis 130. The socket 116 is illuminated for locating the male connector, for example, electrical connector 16, in the female electrical assembly 110.

The electrical interconnect assembly 110 may include a light guide 120 having a face 132 circumscribing the opening 124 of the socket 116 and aperture 126. The light guide 120 directs light from the light emitter 118 to exit the housing 112 from the terminal end to substantially illuminate the face 132 of the electrical interconnect assembly 110 and within the periphery of the socket 116. The light guide 120 may include a front surface 144 having an opening 146 for receiving a connector, a top wall 152 and bottom wall 154, and two sidewalls 156, 158. The front surface 144 of the light guide 120 substantially aligns with the terminal end 122 of the housing 112. In the assembled configuration, the front surface 144 of the light guide 120 abuts the circumference of the opening 124 to provide 360 degrees of illumination around the female connector assembly 110. In another configuration, the light guide 120 is coupled to or is integral to the housing 112.

The light is directed from the back wall 128 within the periphery of the socket 116 and in some embodiments, through the light guide 120 as well. Therefore, light can be projected substantially along the longitudinal axis 130 about the periphery of the socket 116, or within the periphery of the connector or both about and within the periphery of the socket 116. This provides, among other things, light sufficient for illuminating the connector, port or adaptor area on a device, such as a USB receptacle of a device, or on a separate adaptor or connector. The light guide 120 is preferably a translucent or transparent (i.e., clear) housing made of acrylic plastic or other types of materials that permit passage of a substantial amount of light.

Preferably, the light emitter 118 is a light emitting diode (LED) light bulb secured or bonded to the back wall 128 or electrical conductor 164 as described supra. Alternatively, the back wall 128 can include a recess or aperture to receive the light emitter 118, or to seat a portion of the light emitter 118. In yet another configuration, the light emitter 118 can be suspended or encapsulated in a material, such as a translucent or transparent plastic forming at least a portion of the housing 112. It should be appreciated by those having ordinary skill in the art, however, that other types of light bulbs known in the art can be used. Further, more than one light emitter 118 can be used to light the socket 116 of the female connector assembly.

The female electrical interconnect assembly 110 in some configurations includes a tongue 160 disposed within the socket 116 and electrical contacts 162 in communication with the electrical conductor 164. Typically, the tongue 160 is substantially parallel to and proximate the bottom of the socket 116 forming a first space 166 between the sidewall 119*a* of the socket 116 and a top surface 168 of the tongue 160 and a second space 170 between the sidewall 119*b* of the socket 116 and a bottom surface 172 of the tongue 160. The receptacle 116 having light directed from the light emitter 118 though both the first space 166 and the second space 170. It should be appreciated by those having ordinary skill in the art that female ports, connectors and adaptors may also or alternatively include pins, walls, and apertures and that it is contemplated that light will be directed around such features to illuminate a substantial portion of the socket 116.

The lighted electrical interconnect assembly 110 can be powered by a battery, with the device interface, or via an electrical outlet as described supra.

While the invention has been described in connection with a particular embodiment, it is not intended to limit the scope of the invention to the particular form set forth, but on the contrary, it is intended to cover such alternatives, modifications, and equivalents as may be included within the spirit and scope of the invention as defined by the appended claims.

The invention claimed is:

1. An electrical interconnect assembly comprising:

(a) a housing having a terminal end;

(b) a receptacle in the housing, the receptacle having an opening at the terminal end of the housing and a back wall, the receptacle having a longitudinal axis extending orthogonally from the back wall;

(c) a light emitter within the receptacle, the receptacle directing a first portion of light from the light emitter to pass through the receptacle to exit the housing from the terminal end to substantially illuminate the receptacle along the longitudinal axis; and (d) a light guide having a face circumscribing the receptacle, the light guide directing a second portion of the light from the light emitter to exit the housing from the terminal end to substantially illuminate the face.

2. The electrical interconnect assembly of claim 1 wherein the receptacle further comprises opposing sidewalls, a back wall, and a tongue substantially parallel to and proximate one of the opposing sidewalls of the receptacle forming a first space between the opposing sidewall of the receptacle and a top surface of the tongue and a second space between the other opposing sidewall of the receptacle and a bottom surface of the tongue, the receptacle directing light from the light emitter though both the first space and the second space.

3. The electrical interconnect assembly of claim 2, wherein the light emitter is proximate the back wall of the receptacle.

4. The electrical interconnect assembly of claim 1 further comprising a switch for selectively operating the light emitter.

5. The electrical interconnect assembly of claim 1 further comprising an electrical conductor disposed within the housing and an electrical contact within the receptacle, the electrical contact in electrical communication with the electrical conductor.

6. An electrical interconnect assembly for use with a male connector, comprising:

(a) a housing having a terminal end, the terminal end having an aperture;

(b) an electrical conductor within the housing;

(c) a female receptacle portion at the terminal end of the housing, the female receptacle portion having an opening aligned with the aperture and defined by four sidewalls and a back wall opposite the opening, each of the sidewalls including an inside surface facing the male connector when the male connector is in an inserted position;

(d) a longitudinal axis orthogonal to the back wall;

(e) at least one light emitter proximate the electrical conductor, the female receptacle portion directing a first portion of light from the light emitter through the female receptacle portion to exit the housing from the terminal end to substantially illuminate the opening of the female receptacle portion along the longitudinal axis; and (f) a light guide having a face circumscribing the female receptacle portion, the light guide directing a second portion of light from the light emitter to exit the housing from the terminal end to substantially illuminate the face.

7. The electrical interconnect assembly of claim 6, further comprising a tongue proximate one of the sidewalls, the tongue having a top surface and a bottom surface, wherein light from the light emitter is directed along the top surface and the bottom surface of the tongue.

8. The electrical interconnect assembly of claim 6 further comprising a switch for operating the light emitter.

9. An electrical interconnect assembly comprising:

(a) a housing having a terminal end;

(b) a receptacle in the housing, the receptacle having a front portion at the terminal end of the housing having an opening, a back portion within the housing, and sidewalls between the front portion and the back portion;

(c) a longitudinal axis extending parallelly from the sidewalls from the back portion;

(c) a light emitter within the receptacle, the receptacle directing a first portion of light from the light emitter through the receptacle to exit the housing from the terminal end to substantially illuminate the receptacle along the longitudinal axis; and (d) a light guide having a face circumscribing the receptacle, the light guide directing a second portion of light from the light emitter to exit the housing from the terminal end to substantially illuminate the face.

* * * * *